US012612560B2

(12) United States Patent
Siddiqui et al.

(10) Patent No.: US 12,612,560 B2
(45) Date of Patent: Apr. 28, 2026

(54) PREHEATING PROCESS MODULE INTEGRATED WITH COKE HANDLING SYSTEM FOR STEAM CRACKING OF HYDROCARBON FEEDSTOCK

(71) Applicant: Indian Oil Corporation Limited, Mumbai (IN)

(72) Inventors: Shahil Siddiqui, Faridabad (IN); Ponoly Ramachandran Pradeep, Faridabad (IN); Satyen Kumar Das, Faridabad (IN); Madhusudan Sau, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 176 days.

(21) Appl. No.: 18/593,824

(22) Filed: Mar. 1, 2024

(65) Prior Publication Data

US 2024/0294835 A1 Sep. 5, 2024

(30) Foreign Application Priority Data

Mar. 2, 2023 (IN) ..... 202321014174

(51) Int. Cl.
*C10G 9/32* (2006.01)
*F28D 7/10* (2006.01)

(52) U.S. Cl.
CPC ..... *C10G 9/32* (2013.01); *F28D 7/10* (2013.01); *C10G 2300/1003* (2013.01); *C10G 2300/1007* (2013.01); *C10G 2300/4043* (2013.01)

(58) Field of Classification Search
CPC ..... C10G 9/32; C10G 2300/1003; C10G 2300/1007; C10G 2300/4043; C10G 9/38; F28D 7/10
See application file for complete search history.

(56) References Cited

U.S. PATENT DOCUMENTS 5,030,338 A * 7/1991 Harandi ..... C10G 35/095 585/407
5,538,625 A * 7/1996 Sigaud ..... C10G 9/32 208/127
2019/0284485 A1 9/2019 Van Willigenburg
2020/0172814 A1 6/2020 Oud
2021/0006723 A1* 1/2021 Ichihara ..... H04N 23/63
2024/0182795 A1* 6/2024 Wang ..... C10G 9/20

FOREIGN PATENT DOCUMENTS

EP 4424800 A1 * 9/2024 ..... F28D 7/10
WO 2019116122 A1 6/2019

* cited by examiner

*Primary Examiner* — Ellen M Mcavoy
(74) *Attorney, Agent, or Firm* — BLANK ROME LLP

(57) ABSTRACT

A process for steam cracking a hydrocarbon feedstock in a hydrocarbon cracking furnace is disclosed. The hydrocarbon feedstock is preheated in a preheating process module that is integrated with a coke handling system for supply of coke required for combustion. The coke is combusted in presence of oxygen containing gas to heat the heat carrier particles. The heat carrier particles contact the hydrocarbon feedstock to generate preheated hydrocarbon vapors. The flue gas generated by combustion of the coke is contacted with steam in an upper section of the heat source vessel to form dilution steam which mixes with the preheated hydrocarbon vapors to create a mixed stream The mixed stream is fed to the hydrocarbon cracking furnace for thermal cracking.

20 Claims, 3 Drawing Sheets

PREHEATING PROCESS MODULE INTEGRATED WITH COKE HANDLING SYSTEM FOR STEAM CRACKING OF HYDROCARBON FEEDSTOCK

RELATED APPLICATION

This application claims priority to Indian Application No. 202321014174, filed Mar. 2, 2023. The contents of this application is hereby incorporated by reference in its entirety.

FIELD OF THE INVENTION

The present invention relates to a preheating process module for preheating the hydrocarbon feedstock and routing the same into hydrocarbon cracking furnace for cracking to obtain cracked gases, wherein the preheating process module is integrated with coke handling system for supply of petcoke from coke storage yard required for combustion in the preheating module. Further, the module is configured such that the hydrocarbon feedstock is preheated using energy sourced from combustion of petcoke indirectly through a circulating stream of heat carrier particles instead of hot flue gases from convection section thereby saving the convection section energy of the conventional steam cracker furnace and utilizing it for generating very high-pressure steam as a source of utility and also addressing the issues of $CO_2$ emissions which are attributed to steam cracker unit and Delayed coking unit along with petcoke disposal issue.

BACKGROUND OF THE INVENTION

Steam cracking, also referred to as pyrolysis, is a petrochemical process in which saturated hydrocarbons are broken down into smaller, often unsaturated, hydrocarbons. It is the principal industrial method for producing lighter alkenes (olefins), including ethene (or ethylene) and propene (or propylene). Conventional steam cracking utilizes a steam cracking furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with dilution steam. The vaporized feedstock and dilution steam mixture is then introduced into the radiant section where the cracking takes place. The resulting products, including olefins, leave the steam cracking furnace are subjected to sudden quenching to stop the cracking reaction and the quenched products is then routed for further downstream processing.

WO 2019/116122 A1 describes a method for converting naphtha to olefins that includes pre-heating the naphtha in stages in a plurality of heating units such as first heating unit (economizer), second heating unit (firebox) & third heating unit (superheater) where third heating unit is a part of reactor in which catalytic cracking of naphtha occurs.

US 2019/0284485 A1 discloses the invention to perform steam cracking of hydrocarbon feedstock while conserving steam cracking furnace convection section energy consumption for evaporating the hydrocarbon feedstock. Naphtha coming from crude distillation is preheated in three stages using LP, MP, and low quantity HP steam. 16% VHP steam energy is saved however feed is preheated up to 210° C. then again it is preheated in convection zone using flue gas and superheaters.

U.S. Pat. No. 5,538,625 A relates to a method for contacting the light-hydrocarbon feedstock like light paraffins, ethane, propane, butane, gasolines, naphtha and gas oils with heat-transfer particles in a continuous flow reactor wherein the thermal cracking reactions occur in the said reactor itself. Further discloses that at least 90 percent of the particles are regenerated before recycling. The process also provides for the separation of the effluent hydrocarbons using a ballistic separator.

US 2020/0172814 A1 relates to a method and system for preheating hydrocarbon feedstock in a cracking furnace system, by hot flue gasses. The process is environmentally friendly and suitable for carbon capturing.

OBJECT OF THE INVENTION

Accordingly, the main object of the present invention is to provide a preheating process module for preheating the hydrocarbon feedstock and routing the same into hydrocarbon cracking furnace for cracking, wherein the preheating process module is integrated with coke handling system for supply of petcoke from coke storage yard required for combustion in the preheating module.

Another object of the invention is to provide a preheating module wherein the hydrocarbon feedstock is preheated using energy sourced from combustion of petcoke indirectly through a circulating stream of heat carrier particles while capturing the generated $CO_2$ and thereby producing $CO_2$ rich flue gas which can be further sent for purification, capture or utilization. This enables capture of $CO_2$ emitted during petcoke burning, which otherwise would not have been feasible if burned as petcoke in multiple locations of the customers purchasing the petcoke, produced in the Delayed Coking unit, thereby reducing the overall SCOPE-III $CO_2$ emissions.

Another object of the invention is to provide an improved preheating section/convection section for Steam cracker unit wherein the rate of feed preheat, temperature of preheated feed can be controlled without affecting the heat flux/fuel flow rate etc. of radiation section.

Another object of the invention is to provide an improved thermal cracking pattern for the hydrocarbon feedstock by being able to control the residence time distribution among the convection and radiation sections of the Steam cracker as and when required.

Another object of the present invention is to enable reduction of SCOPE-II emission of $CO_2$ from the Steam cracker unit wherein the $CO_2$ emissions that could have occurred elsewhere, while generation of additional utility steam & process steam that are generated through modified convection section design of the present invention.

Another object of the present invention is to generate additional power by use of steam generated additionally from the convection section of the process of present invention.

Another object of the invention is to utilize the coke sourced from either delayed coker unit or fluid coking unit or waste material (biomass, plastic, municipal solid waste etc.) pyrolysis unit or coal plant. Further, heating rate of heat carrier particles can be controlled as the quantity of coke used for combustion is in user control.

Still another object of the invention is to use cyclone separator to remove any contaminants back to the heat sink thus preventing hydrocarbon vapor contamination & deposition.

Advantages of the Present Invention

The present invention has the following advantages over the prior art:

- Utilization of low value petcoke as a heat source coupled with $CO_2$ capture
- Reduction of petcoke make from petroleum refinery thereby addressing petcoke disposal issue & thereby reducing the overall SCOPE-III $CO_2$ emissions
- Heat integration of steam in heat source section for dilution steam generation
- Injection of dilution Steam in heat sink vessel for preventing the coke formation tendency by decreasing the residence time of preheated hydrocarbon feedstock vapors
- Heat transfer between hydrocarbon feedstock and heat carrier particles in heat sink vessel is much faster as there is no deposition of coke on heat carrier particles.

Increasing control on the pre-heating rate and temperature of hydrocarbon feed as compared to conventional convection section of steam cracker furnace by controlling the rate of coke input, heat carrier particle flow rate and other combustion parameters

- Generation of additional power by use of steam generated additionally from the convection section of the process of present invention
- Enable reduction of SCOPE-II emission of $CO_2$ from the Steam cracker unit

SUMMARY OF THE INVENTION

It is seen that different process routes have been described in the prior art for preheating the hydrocarbon feedstock for conversion to light olefins and aromatics. It is worthwhile to note that in the prior art where the hydrocarbon feedstock is pre-heated in stages in a plurality of heating units; steam cracking of light-hydrocarbon feedstock using heat-transfer particles in a continuous flow reactor wherein the thermal cracking reactions occur in the said reactor itself; and preheating hydrocarbon feedstock in a convection section of cracking furnace system by hot flue gases. However, these prior arts have not disclosed any preheating setup which is integrated with coke handling system for supply of petcoke from coke storage yard for combustion in order to preheat the hydrocarbon feedstock using energy sourced from combustion of petcoke indirectly through a circulating stream of heat carrier particles instead of hot flue gases from convection section thereby saving the convection section energy of the conventional steam cracker furnace and utilizing it for generating very high-pressure steam as a source of utility. From this it is seen that there is a requirement for a preheating process module which not only preheat the hydrocarbon feedstock for cracking into cracked gases but also addressing the issues of $CO_2$ emissions which are attributed to steam cracker unit and Delayed coking unit along with petcoke disposal issue.

The current invention overcomes the following limitation which exists in the prior arts:

- Scope-II $CO_2$ emissions in conventional steam cracker unit
- Petcoke disposal issue from petroleum refinery
- Non-utilization of convection zone energy for generation of very high-pressure steam
- Feed contamination which in turn leads to deposition in cracking section In some embodiments, the present disclosure provides a cracking furnace system for converting a hydrocarbon feedstock into cracked gas comprising a convection section used for generation of very high-pressure steam, a radiant section for hydrocarbon feedstock cracking, while the hydrocarbon feedstock is preheated by a preheating process module integrated with coke handling system.

In some embodiments, the present disclosure provides an improved preheating section/convection section for Steam cracker unit wherein the rate of feed preheat, temperature of preheated feed can be controlled without affecting the heat flux/fuel flow rate etc. of radiation section. This is not generally feasible in conventional Steam cracker units wherein, to change the feed preheat temperature of the feedstock at the outlet of convection section, it is required to increase/decrease the fuel flow rate to the burners, which could also impact the heat flux and heat transfer of the radiation section. This also might induce additional coke formation in the radiation section in case the temperature overshoots etc. occur in the radiation section while trying to modify the convection section operating parameters. This also might affect the overall product yields from the Steam cracker unit.

In one embodiment, the present disclosure also provides a preheating process module integrated with coke handling system for preheating the hydrocarbon feedstock and routing the same into the hydrocarbon cracking furnace for conversion into cracked gases, comprising steps of:

a. feeding the coke lumps (1) after screening from coke storage yard to a hopper (2) and conveying to roller crusher (4) for crushing through conveyer belts (3) to obtain the crushed coke (5);
b. feeding the crushed coke (5) after screening to second hopper (6) and conveying the coke of desired particle size (7) from hopper to coke storage vessel (9) through second conveyer belt (8);
c. conveying the coke (11) from the coke storage vessel (9) to the heat source vessel (12), using pneumatic conveying through oxygen containing gas (10), wherein coke (13) is combusted in presence of oxygen containing gas (14) to generate the heat which in turn heat up of the heat carrier particles (15);
d. transporting the heat carrier particles (15) present in the heat source vessel fluidized with the help of oxygen containing gas (14) to stripper (16), wherein oxygen and residual coke particulates is stripped off using steam (18) leaving as mixture of oxygen containing gas & steam (27) from top of vessel ensuring no oxygen reaches to heat sink vessel (20); transporting heat carrier particles (19) to the heat sink vessel (20) wherein hydrocarbon feedstock supplied into the vessel (21) is contacted with the heat carrier particles which in turn preheats the hydrocarbon feedstock;
e. recycling back the heat carrier particles (22) to heat source vessel using pneumatic conveying through steam (24) for reheating;
f. feeding preheated hydrocarbon vapors to cyclone separator (23) to remove any unwanted particles which may acts as a source of furnace fouling;
g. contacting the flue gas (38) generated by combustion of coke with steam (25) in the upper section of heat source vessel using shell & tube type arrangement (26) resulting in the formation of dilution steam (17) at desired temperature & pressure leaving the exhaust gas mixture of $CO_2$ and steam (28) from top of heat source vessel;
h. cooling the mixture (28) in a cooler (29) and feeding to separator (30) to obtain $CO_2$ rich gas (31) from top of separator which can be utilized for carbon capture & utilization block (33) to produce value added products (34) and condensate (32) from bottoms;

i. routing the dilution steam (17) from shell & tube type arrangement to the heat sink vessel (20) wherein it mixes with preheated hydrocarbon vapors to create mixed stream (35) while increasing the space velocity of mixture and reduces the partial pressure, thereby reducing the coke formation tendency in the vessel itself;

j. feeding the mixed stream (35) to radiation section (36) of cracking furnace wherein thermal cracking of hydrocarbon occurs resulting in the formation of cracked gases (37) which are routed to further separation sections for recovery and recycle of unconverted gases back to the heat sink vessel (20).

In preferred embodiment, the hydrocarbon feedstock is selected from Ethane, Propane, $C_4$ hydrocarbons, straight run naphtha, kerosene from atmospheric distillation unit, other paraffinic/olefinic naphtha, kerosene from secondary processing units of refinery such as Fluid Catalytic cracking, Hydrocracking, light oils produced from waste oils such as waste plastic pyrolysis oil, used lubricating oil, bio-oil and other waste oils and combination(s) thereof and requires preheating temperature up to 550-650° C., preferably from 590 to 625° C.

In another preferred embodiment, the location of injection of the mixed feedstock (35) in the hydrocarbon cracking furnace is made at a location in convection section or radiation section inlet which shall be selected based on the temperature of the mixed feedstock.

In another preferred embodiment, fraction of dilution steam (17) is injected in the heat sink vessel (20) and remaining fraction injection in hydrocarbon cracking furnace is made at a location in convection section or radiation section inlet which shall be selected based on the temperature of the mixed feedstock.

In another preferred embodiment, the coke used for combustion is not produced on heat carrier particles internally instead taken either from Delayed Coker Unit or fluid coking unit or waste material (biomass, plastic, municipal solid waste etc.) pyrolysis unit or coal plant.

In yet another preferred embodiment, coke used in the process can be fuel grade coke, fluid coke, anode grade coke, bio char, coal or combination(s) thereof.

In yet another preferred embodiment, the combustion of coke for heat generation along with fluidization of heat carrier particles in heat source vessel can be done either through pure oxygen or air or a combination thereof. Further, excess oxygen is supplied in comparison to stoichiometric oxygen requirement, in the range of 1 to 40 mol %

In yet another preferred embodiment, top section of heat source vessel comprises shell and tube heat exchanger which superheats the steam to generate dilution steam which is then mixed with vaporized hydrocarbon feedstock for reducing the residence time in heat sink vessel before routing to radiation section.

In yet another preferred embodiment, the steam used for generation of dilution steam can be Low Pressure (LP) or Medium Pressure (MP) steam.

BRIEF DESCRIPTIONS OF DRAWINGS

DETAILED DESCRIPTION OF THE INVENTION

Figure 1:
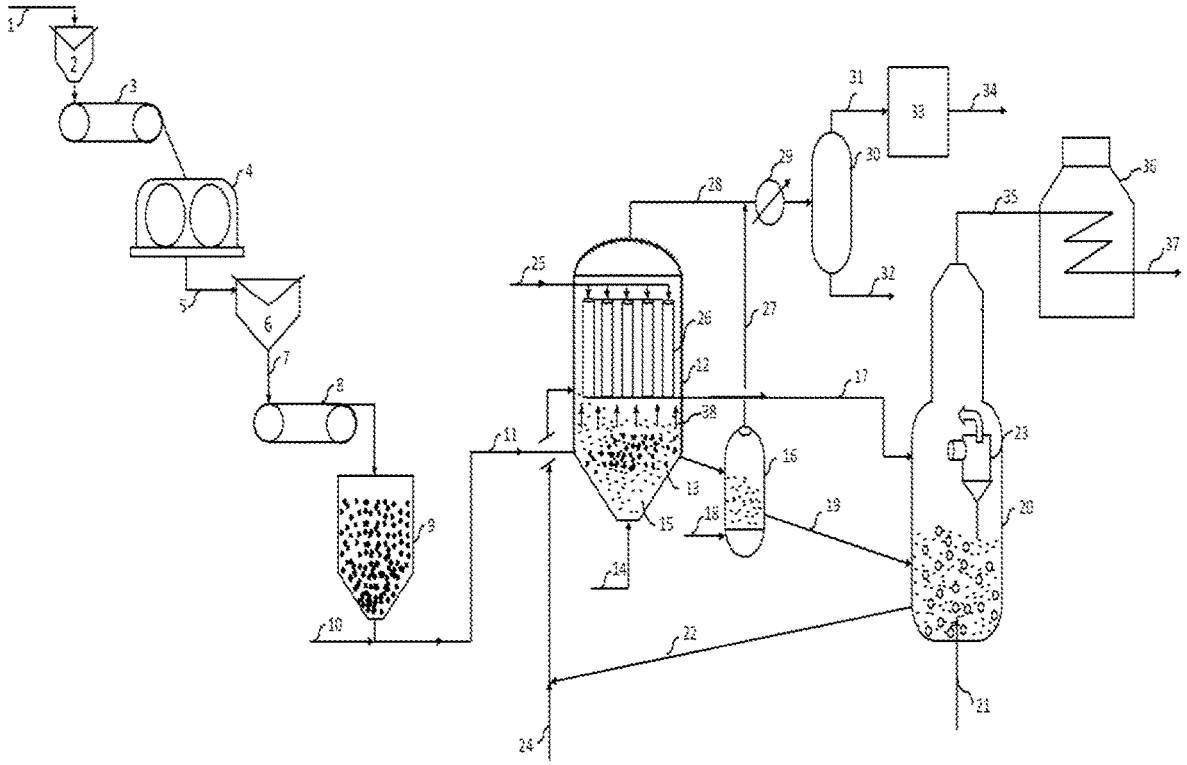
FIG. 1 illustrates process flow diagram of present invention

While the invention is susceptible to various modifications and alternative forms, specific embodiment thereof will be described in detail below. It should be understood, however that it is not intended to limit the invention to the particular forms disclosed, but on the contrary, the invention is to cover all modifications, equivalents, and alternative falling within the scope of the invention as defined by the appended claims.

The following description is of exemplary embodiments only and is not intended to limit the scope, applicability, or configuration of the invention in any way. Rather, the following description provides a convenient illustration for implementing exemplary embodiments of the invention. Various changes to the described embodiments may be made in the function and arrangement of the elements described without departing from the scope of the invention.

Feedstock

The hydrocarbon feedstock used in the process is selected from Ethane, Propane, $C_4$ hydrocarbons, straight run naphtha from atmospheric distillation unit, other paraffinic/olefinic naphtha from secondary processing units of refinery such as Fluid Catalytic cracking, Hydrocracking, light oils produced from waste oils such as waste plastic pyrolysis oil, used lubricating oil, bio-oil and other waste oils and combination(s) thereof.

Coke Handling System

The present invention utilizes low value coke for combustion in heat source vessel of preheating module. This low value coke is transported to the heat source vessel via coke handling system which comprises of first coke screener to screen the coke lumps from coke yard, hopper for holding the screened coke, conveyer belt for carrying the screen coke to roller crusher, roller crusher for coke crushing, second coke screener for screening/particle size separation of crushed coke to obtain desired particle size coke particles of size in the range of 40 microns to 10 mm, hopper for storing the crushed and screened coke, conveyer belt for carrying the coke from hopper to coke storage vessel, which is finally injected to heat source vessel by means of conveyer belt or pneumatic conveying system.

Coke for Combustion

The present invention focused on utilizing the low value coke for generating the energy required for heating the heat carrier particles which in turn heat the hydrocarbon feedstock. Coke handling system is integrated with preheating module for supply of desired particle size coke in the range of 40 microns to 10 mm for combustion. This coke/coke powder is not produced internally within the system instead is taken from external source which can be either from delayed coker unit, or fluid coking unit or waste material (biomass, plastic, municipal solid waste etc.) pyrolysis plants, coal plant. The coke used for combustion in the process can be fuel grade coke, fluid coke, anode grade coke, bio char, coal or combination(s) thereof.

Heat Source Vessel Section

Heat source vessel is used for heating the heat carrier particles which in turn heats up the hydrocarbon feedstock. The vessel comprises of coke inlet from side wall and recycle heat carrier particles enters just above the coke inlet while oxygen containing gas enters from bottom of the vessel. Combustion reaction takes place between coke particles and oxygen containing gas, with excess oxygen is supplied in comparison to stoichiometric oxygen requirement, in the range of 1 to 40 mol %, which generates $CO_2$ rich hot flue gases. The top section of vessel comprises of shell and tube heat exchanger orientated in a way to allow counter current flow steam for heat exchanging with flue gases generated due to combustion of coke. The operating temperatures of heat source vessel is in the range of 600-800° C., operating pressure is in the range of 0.5-3 bar, coke to feed ratio is the range of 0.02-1 (wt/wt). The temperature of dilution steam is the range of 400-650° C. and pressure in the range of 0.5-3 bar. The dilution steam coming out of heat source vessel is mixed with hydrocarbon feedstock in heat sink vessel such that dilution steam to hydrocarbon feedstock ratio is in the range of 0.1-1.5 and residence time of mixture in the heat sink vessel is in the range of 0.1-5 sec. The temperature of steam used for generation of dilution steam is in the range of 110-300° C., pressure in the range of 3-20 $Kg/cm^2$. The steam used for generation of dilution steam can be LP or MP steam. Further, the additional steam generated in convection section can be utilized for power generation using turbines thereby obtaining low pressure & medium pressure steam which can be utilized back in this process itself. The exhaust mixture (28) containing $CO_2$ rich gas and steam leave the top section of heat source vessel and is fed to separator where $CO_2$ rich gas is obtained from top having $CO_2$ in the range of 80-99% is obtained which can be further purified and utilized for carbon capture & utilization.

Heat Carrier Particles

Heat carrier particles is utilized for preheating the hydrocarbon feedstock wherein the same present in the heat source vessel is transported to heat sink vessel by fluidization using oxygen containing gas via stripper in between to ensure no oxygen reaches to heat sink vessel. The heat carrier particles comprise spent FCC catalyst, spent reformer catalyst, inert aluminosilicate particles, alumina balls, silicon carbide, fly ash, metallic oxides and combination(s) thereof with minimum fluidization velocity in the range of 0.01-0.8 m/s, heat capacity is in the range of 300-1000 J/Kg-K and particle size distribution in the range of 40 microns to 3 mm.

Heat Sink Vessel Section

The hydrocarbon feedstock stream supplied to the heat sink vessel is directly contacted with the heat carrier particles in the heat sink vessel, having contact time ranging from 0.5-30 sec and heat carrier particles to hydrocarbon feedstock ratio is the range of 1-10 (wt/wt), which in turn preheats the hydrocarbon feedstock upto desired temperatures. After contacting, heat carrier particles are recycled back to heat source section using pneumatic conveying through steam for reheating. The operating temperatures of heat sink vessel is in the range of 400-700° C., operating pressure is in the range of 0.1-3 bar.

Operating Conditions of the Cracking Section

The operating temperature of the radiation/cracking section is in the range of 750-950° C., pressure drop is in the range of 0.5-2 bar, residence time in the range of 0.1-1 sec, steam to feed ratio in the range of 0.3 to 1.

Description of Process and System Flow Scheme

In the process and system of present invention as depicted in FIG. 1, the coke lumps (1) after screening from coke storage yard is fed to a hopper (2) and conveying to roller crusher (4) for crushing through conveyer belts (3) to obtain the crushed coke (5). The crushed coke (5) after screening is fed to second hopper (6) and the coke of desired particle size (7) from hopper is conveyed to coke storage vessel (9) through second conveyer belt (8). The coke (11) from coke storage vessel is fed to the heat source vessel (12), using pneumatic conveying through oxygen containing gas (10), wherein coke (13) is combusted in presence of oxygen containing gas (14) to generate the heat which in turn heat up of the heat carrier particles (15). The heat carrier particles (15) present in the heat source vessel is transported with the help of oxygen containing gas (14) to stripper (16) wherein oxygen and residual coke particulates is stripped off using steam (18) leaving as mixture of oxygen containing gas & steam (27) from top of vessel ensuring no oxygen reaches to heat sink vessel (20) and from the stripper the heat carrier particles (19) is transported to the heat sink vessel (20) wherein hydrocarbon feedstock (21) supplied into the vessel (20) is contacted with the heat carrier particles which in turn preheats the hydrocarbon feedstock upto desired temperatures while recycling back the heat carrier particles (22) to heat source vessel (12) using pneumatic conveying through steam (24) for reheating. Preheated hydrocarbon vapors are then fed to cyclone separator (23) to remove any unwanted particles which may acts as a source of furnace fouling. The flue gas (38) generated by combustion of coke is then contacted with Steam (25) in the upper section of heat source vessel using shell & tube type arrangement (26) resulting in the formation of dilution steam (17) at desired temperatures and pressure leaving exhaust mixture of $CO_2$ and steam (28). The mixture (28) is cooled in a cooler (29) and fed to separator (30) to obtain $CO_2$ rich gas (31) from top of separator which can be utilized for carbon capture & utilization block (33) to produce value added products (34) and condensate (32) from bottoms. The dilution steam (17) from shell & tube type arrangement is then routed to the heat sink vessel (20) wherein it mixes with preheated hydrocarbon vapors to create mixed stream (35), while increasing the space velocity of mixture and reduces the partial pressure, thereby reducing the coke formation tendency in the vessel itself. The mixed stream (35) is finally fed to radiation section (36) of cracking furnace wherein thermal cracking of hydrocarbon occurs resulting in the formation of cracked gases (37), which are routed to further separation sections for recovery and recycle of unconverted gases back to the heat sink vessel (20).

In preferred embodiment, the hydrocarbon feedstock is selected from Ethane, Propane, $C_4$ hydrocarbons, straight run naphtha, kerosene from atmospheric distillation unit, other paraffinic/olefinic naphtha, kerosene from secondary processing units of refinery such as Fluid Catalytic cracking, Hydrocracking, light oils produced from waste oils such as waste plastic pyrolysis oil, used lubricating oil, bio-oil and other waste oils and combination(s) thereof and requires preheating temperature up to 550-650° C., preferably from 590 to 625° C.

In another preferred embodiment, the location of injection of the mixed feedstock (35) in the hydrocarbon cracking furnace is made at a location in convection section or radiation section inlet which shall be selected based on the temperature of the mixed feedstock.

In another preferred embodiment, fraction of dilution steam (17) is injected in the heat sink vessel (20) and remaining fraction injection in hydrocarbon cracking furnace is made at a location in convection section or radiation section inlet which shall be selected based on the temperature of the mixed feedstock.

In another preferred embodiment, the coke used for combustion is not produced on heat carrier particles internally instead taken either from Delayed Coker Unit or fluid coking unit- or waste material (biomass, plastic, municipal solid waste etc.) pyrolysis unit or coal plant.

In yet another preferred embodiment, coke used in the process can be fuel grade coke, fluid coke, anode grade coke, bio char, coal or combination(s) thereof.

In yet another preferred embodiment, the combustion of coke for heat generation along with fluidization of heat carrier particles in heat source vessel can be done either through pure oxygen or air or a combination thereof. Further, excess oxygen is supplied in comparison to stoichiometric oxygen requirement, in the range of 1 to 40 mol %.

In yet another preferred embodiment, top section of heat source vessel comprises shell and tube heat exchanger which superheats the steam to generate dilution steam which is then mixed with vaporized hydrocarbon feedstock for reducing the residence time in heat sink vessel before routing to radiation section.

In yet another preferred embodiment, the steam used for generation of dilution steam can be Low Pressure (LP) or Medium Pressure (MP) steam.

Figure 2:
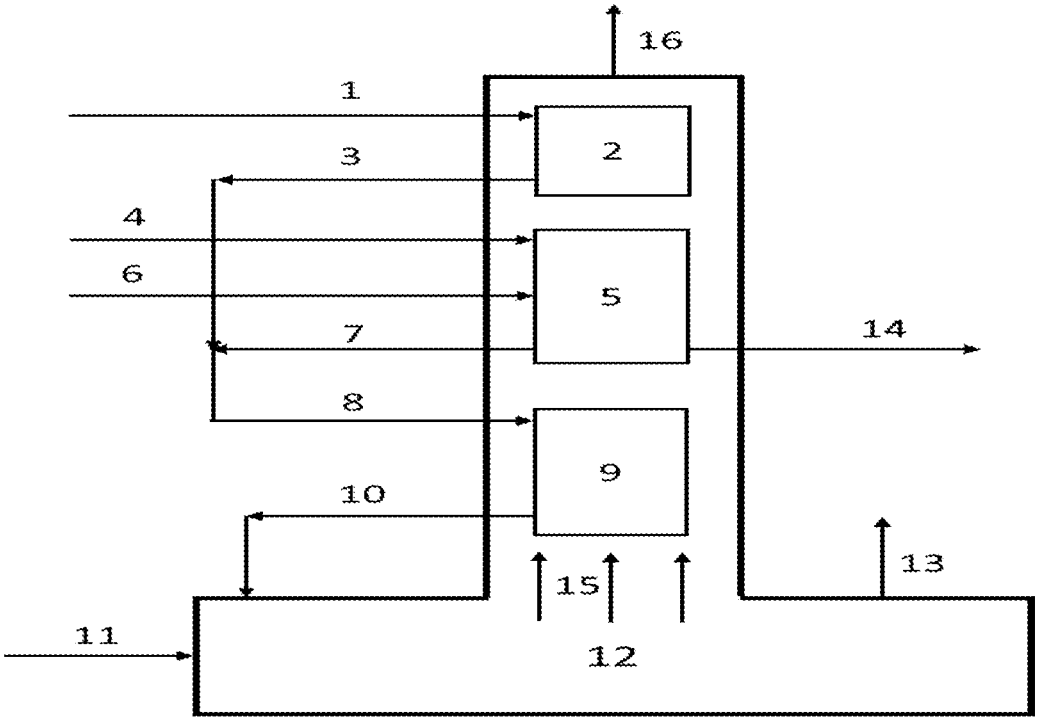
FIG. 2 illustrates the convection section of conventional furnace

Comparison of the Convection Section of Present Invention with Conventional Furnace In conventional furnace as depicted in FIG. 2, the hydrocarbon feedstock (1) entered the convection section which comprises of upper preheater section (2) to obtain vaporized hydrocarbon feedstock (3). The boiler feed water (4) & dilution steam (6) enters the boiler water preheater & steam superheater section (5) to obtain superheated dilution steam (7) and very high-pressure steam (14). The vaporized hydrocarbon feedstock (3) is mixed with superheated dilution steam (7) to obtain resultant mixed stream (8) of hydrocarbon feedstock and dilution steam depending on the steam to hydrocarbon feedstock ratio. The resultant mixed stream (8) is then sent to lower preheater section (9) to obtain desired preheated stream (10) for routing to radiation section (12) which is maintained at cracking temperatures by combustion of fuel gas (11). The cracking of preheated stream (10) takes place in radiation section to obtain cracked gases (13). The upper preheater, boiler water preheater & steam superheater section and lower preheater section exchanges heat from hot flue gas (15) coming from radiation section to the convection section of the furnace. The hot flue gas after exchanging heat with above sections exits the furnace from top as stream (16).

Figure 3:
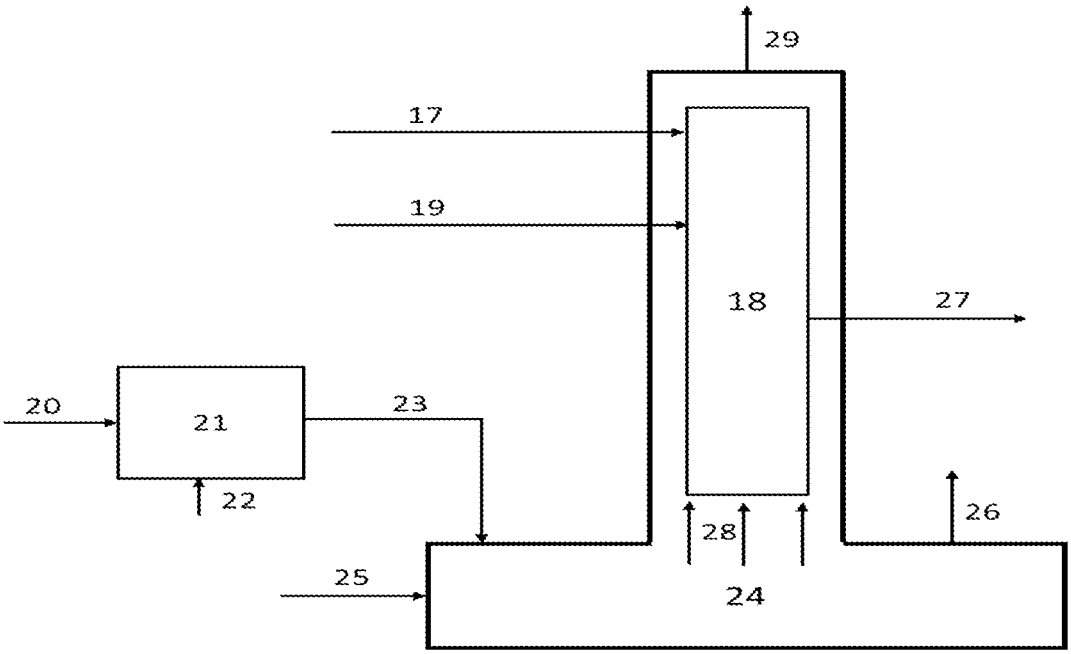
FIG. 3 illustrates the convection section of present invention

In the present invention as depicted in FIG. 3, instead of feeding the hydrocarbon feedstock (20) and steam (22) to the convection section of the furnace for preheating using flue gases coming from radiation section, it is routed to a preheating process module (21) as described in FIG. 1 for preheating the hydrocarbon feedstock and steam at desired temperatures and routing the preheated mixture containing hydrocarbon feedstock and dilution steam (23) into the hydrocarbon cracking furnace (24) maintained at cracking temperatures by combustion of fuel gas (25) for conversion into cracked gases (26). The upper preheater, boiler water preheater & steam superheater section and lower preheater section of convection section of conventional furnace now can be combined as one preheating section (18) wherein boiler feed water (17) along with dilution steam (19) can be utilized for generating additional very high-pressure steam (27) by exchanging heat from hot flue gas stream (28) coming from radiation section to the convection section of the furnace. The hot flue gas after exchanging heat with above sections exits the furnace from top as stream (29).

It is to be note that the location of injection of the mixed feedstock (23) in the hydrocarbon cracking furnace is made at a location in convection section or radiation section inlet which shall be selected based on the temperature of the mixed feedstock. When we implement this system commercially, the additional very high-pressure steam can be generated from idle convection section or part of convection section using flue gases heat depending on the location of injection of the mixed feedstock in the hydrocarbon cracking furnace.

Example 1

As the underlying chemical engineering principles of the process could be estimated by mathematical calculations known in the art of chemical engineering, the process data given in the same has been generated using said approach. A single heater of steam cracker furnace was considered wherein Straight Run Naphtha (SRN) is taken with inlet temperature 60° C. & heated & dilution steam was heated at 200° C. upto 590° C. using heater. Taking the capacity of typical naphtha cracker unit as 0.5 MMTPA, the amount of heat required is close to 32 MMKcal/hr. Also, the quantity of coke required to maintain the temperature of heat source vessel at 700° C. & preheat the said capacity feed is close to 33.5 kTA (considering heat of combustion of coke ~32 KJ/gm coke). This way, we can say that by utilizing low value coke, we are saving almost 32 MMKcal/hr of energy required in the convection section which is further utilized in generating very high-pressure steam of 46 MT/hr which further can be utilized in generating electric power using steam turbines as shown in Table 1. The LP steam produced as result of that can be further utilized in plant operations and utility. The total amount of SCOPE-II $CO_2$ which could have been produced due to generation of additional 46 MT/hr Very High-Pressure steam is close to 82 TMTPA per 0.5 MMTPA of hydrocarbon processed is getting reduced from the present process. The Coke utilized in generating the energy for preheating hydrocarbon feedstocks in turn results in reduction of equivalent SCOPE III $CO_2$ of 107 TMTPA per 0.5 MMTPA of hydrocarbon processed, owing to carbon capture. Total $CO_2$ emission reduction potential of present invention is close to 296 TMTPA $CO_2$/0.5 MMTPA hydrocarbon processed compared to conventional steam cracker furnace as shown in Table 2.

Energy Balance of Convection Section of Furnace with/without Preheating of Naphtha Using Coke:

The calculations of heat requirements in convection section of conventional furnace and present invention are shown in Table 1 and $CO_2$ emissions reduction is shown in Table 2 respectively.

TABLE 1

Heat requirements in convection section of conventional & present cracker furnace

| Conventional Cracker Scheme | |
|---|---|
| Capacity of Typical Naphtha Cracker, MMTPA | 0.5 |
| Steam to Hydrocarbon ratio | 0.5 |
| Amount of energy used in convection section, MW | 37 |
| Process of present invention | |
| Amount of heat carrier particles required, MT/hr | 284 |
| Heat of combustion of coke @ 700 C., KJ/g | 32.3 |
| Amount of Coke required, kTA | 33.5 |
| Heat energy saved, MW | 37 |
| Amount of energy required to produce 1 Kg Saturated Steam, MJ/Kg | 2.9 |
| Additional Quantity of Steam produced, MT/hr | 46 |

TABLE 2

| $CO_2$ emissions reduction in present invention vs conventional furnace | |
|---|---|
| Conventional Scheme (Basis: 0.5 MMTPA capacity) $CO_2$ emissions from FG burning in Steam Cracker furnace + DCU Petcoke burning | |
| Fuel Gas required in Steam cracker furnace (Assuming 100% CH4), MT/hr | 9.59 |
| Amount of $CO_2$ produced from Steam cracker furnace fuel burning, TMTPA | 211 |
| SCOPE-III $CO_2$ emission by 33.5 TMPTA Petcoke produced from Delayed Coker Unit, when subjected to burning in boilers (without CO2 capture) | 107 |
| Total $CO_2$ produced, TMTPA | 318 |
| Proposed Scheme (Basis: 0.5 MMTPA capacity) | |
| $CO_2$ emissions from FG burning in furnace, TMTPA | 211 |
| $CO_2$ emissions saved during generation of additional steam in convection section of the Furnace of present process scheme, TMTPA (if done elsewhere without CO2 capture) | 82 |
| Coke required for preheating naphtha, TMTPA | 33.5 |
| SCOPE III $CO_2$ emission saved by preventing Petcoke burning in boilers, TMTPA | 107 |
| Total $CO_2$ emissions in proposed scheme, TMTPA | 22 |
| Total $CO_2$ reduction potential, TMTPA | 296 |

We claim:

1. A process for steam cracking a hydrocarbon feedstock in a hydrocarbon cracking furnace, wherein the hydrocarbon feedstock is preheated in a preheating process module, and wherein the preheating process module is integrated with a coke handling system for supply of coke required for combustion from a coke storage yard, the process comprising:

a. feeding coke lumps after screening from the coke storage yard to a hopper and conveying to a roller crusher for crushing through conveyer belts to obtain crushed coke;

b. feeding the crushed coke after screening to a second hopper and conveying the coke of a desired particle size from the second hopper to a coke storage vessel through a second conveyer belt;

c. conveying the coke from the coke storage vessel to a heat source vessel, wherein the coke is combusted in presence of an oxygen containing gas to generate heat to heat up heat carrier particles;

d. transporting the heat carrier particles from the heat source vessel to a stripper, wherein oxygen and residual coke particulates are stripped off using steam leaving as a mixture from a top of the heat source vessel ensuring no oxygen reaches to a heat sink vessel;

e. transporting the heat carrier particles to the heat sink vessel wherein the hydrocarbon feedstock supplied into the heat sink vessel is contacted with the heat carrier particles which in turn preheat the hydrocarbon feedstock to generate preheated hydrocarbon vapors;

f. recycling back the heat carrier particles to the heat source vessel for reheating;

g. feeding the preheated hydrocarbon vapors to a cyclone separator to remove unwanted particles;

h. contacting flue gas generated by combustion of the coke with steam in an upper section of the heat source vessel using shell and tube type arrangement resulting in the formation of dilution steam at a desired temperature and pressure leaving an exhaust gas mixture comprising $CO_2$ and steam from the top of heat source vessel;

i. cooling the exhaust gas mixture in a cooler and feeding to a separator to obtain $CO_2$ rich gas stream from a top of the separator;

j. routing the dilution steam from shell and tube type arrangement to the heat sink vessel wherein it mixes with the preheated hydrocarbon vapors to create a mixed stream thereby reducing the coke formation tendency in the heat source vessel;

k. feeding the mixed stream to the hydrocarbon cracking furnace wherein thermal cracking of the hydrocarbon feedstock occurs resulting in the formation of cracked gases, wherein the cracked gases are routed to further separation sections for recovery and recycle of unconverted gases back to the heat sink vessel.

2. The process as claimed in claim 1, wherein the hydrocarbon feedstock is selected from the group consisting of ethane, propane, $C_4$ hydrocarbons, straight run naphtha, kerosene from atmospheric distillation unit, paraffinic, and olefinic naphtha, kerosene from secondary processing units of refinery, and light oils produced from waste oils, wherein the waste oils are selected from the group consisting of waste plastic pyrolysis oil, used lubricating oil, bio-oil, a combination thereof.

3. The process as claimed in claim 1, wherein preheating of the hydrocarbon feedstock is carried out at a temperature in a range from 550-650° C.

4. The process as claimed in claim 1, wherein the mixed stream is fed to the hydrocarbon cracking furnace at a location in a convection section or in a radiation section, depending on a temperature of the mixed stream.

5. The process as claimed in claim 1, wherein the coke used for combustion in the heat source vessel is selected from the group consisting of fuel grade coke, fluid coke, anode grade coke, bio char, coal, and a combination thereof and the coke used for combustion in the heat source vessel is selected from the group consisting of Delayed Coker Units, pyrolysis units, and coal plants.

6. The process as claimed in claim 1, wherein the coke is subjected to size reduction and size separation to form coke particles of size in a range of 40 microns to 10 mm.

7. The process as claimed in claim 1, wherein the coke is injected into the heat source vessel by a conveyer belt or a pneumatic conveying system.

8. The process as claimed in claim 1, wherein combustion of the coke in the heat source vessel is done either through pure oxygen, air, or a combination thereof.

9. The process as claimed in claim 1, wherein for the combustion of coke, oxygen is supplied in an excess than a stoichiometric oxygen requirement, and is in a range of 1 to 40 mol %.

10. The process as claimed in claim 1, wherein the heat source vessel is operated at a temperature in a range of 600-800° C., and at a pressure in a range of 0.5-3 bar.

11. The process as claimed in claim 1, wherein the coke to the hydrocarbon feedstock ratio is in a range of 0.02-1.

12. The process as claimed in claim 1, wherein the heat sink vessel is operated at a temperature in a range of 400-700° C., and a pressure in a range of 0.1-3 bar.

13. The process as claimed in claim 1, wherein the heat carrier particles have a fluidization velocity in a range of 0.01-0.8 m/s, and a heat capacity in a range of 300-1000 J/Kg-K.

14. The process as claimed in claim 1, wherein the heat carrier particles are selected from the group consisting of spent FCC catalyst, spent reformer catalyst, inert aluminosilicate particles, alumina balls, silicon carbide, fly ash, metallic oxides, and a combination thereof, and wherein the heat carrier particles have a particle size distribution in a range of 40 microns to 3 mm.

15. The process as claimed in claim 1, wherein the heat carrier particles to the hydrocarbon feedstock ratio is in a range of 1-10, and a contact time between the hydrocarbon feedstock and the heat carrier particles ranges from 0.5-30 sec.

16. The process as claimed in claim 1, wherein an orientation of shell and tube heat exchanger ensures a counter current flow between flue gases generated due to combustion of the coke and the steam.

17. The process as claimed in claim 1, wherein temperature of the steam used for generation of dilution steam is in a range of 110-300° C.

18. The process as claimed in claim 1, wherein temperature of the dilution steam is in a range of 400-650° C.

19. The process as claimed in claim 1, wherein the dilution steam to the hydrocarbon feedstock ratio is in a range of 0.1-1.5 and residence time of the mixture in the heat sink vessel is in a range of 0.1-5 sec.

20. The process as claimed in claim 1, wherein the $CO_2$ rich gas stream is sent for further purification, capture or utilization.

* * * * *